US012173582B2

(12) United States Patent
Vo et al.

(10) Patent No.: US 12,173,582 B2
(45) Date of Patent: Dec. 24, 2024

(54) FLOW DIFFUSER

(71) Applicant: Velikx LLC, Katy, TX (US)

(72) Inventors: Oghomwen Vo, Katy, TX (US); Felix Ay, Tema (GH)

( * ) Notice: Subject to any disclaimer, the term of this patent is extended or adjusted under 35 U.S.C. 154(b) by 96 days.

(21) Appl. No.: 17/767,164

(22) PCT Filed: Oct. 21, 2020

(86) PCT No.: PCT/US2020/056546
§ 371 (c)(1),
(2) Date: Apr. 7, 2022

(87) PCT Pub. No.: WO2021/081015
PCT Pub. Date: Apr. 29, 2021

(65) Prior Publication Data

US 2022/0372841 A1 Nov. 24, 2022

Related U.S. Application Data

(60) Provisional application No. 62/924,464, filed on Oct. 22, 2019.

(51) Int. Cl.
*E21B 33/13* (2006.01)
*E21B 33/14* (2006.01)

(52) U.S. Cl.
CPC ..... *E21B 33/14* (2013.01)

(58) Field of Classification Search
CPC ..... E21B 33/14
See application file for complete search history.

(56) References Cited

U.S. PATENT DOCUMENTS 5,697,442 A * 12/1997 Baldridge ..... E21B 17/10
166/241.1

* cited by examiner

*Primary Examiner* — William D Hutton, Jr.
*Assistant Examiner* — Avi T Skaist
(74) *Attorney, Agent, or Firm* — Tim D. Chheda

(57) ABSTRACT

An apparatus for controlling flow of cement slurry in a well casing includes a cylindrical housing and a hopper within the cylindrical housing to collect the cement slurry. The apparatus further includes tubing, including at least one tube, coupled to the hopper within the cylindrical housing to transport the cement slurry from the hopper to at least one exit port. The apparatus further includes a bottom plate coupled to the tubing, the bottom plate including at least one exit port shaped to diffuse the cement slurry and arranged on the bottom plate such that the cement slurry flows along the entire internal diameter of the well casing.

16 Claims, 3 Drawing Sheets

FLOW DIFFUSER

CROSS-REFERENCE TO RELATED APPLICATIONS

This application claims the benefit of P.C.T. Application No. PCT/US20/56546, filed Oct. 21, 2020 and titled "Flow Diffuser" by Oghomwen Vo and Felix Ay, which itself claims the benefit of U.S. Provisional Application No. 62/924,464, filed Oct. 22, 2019 and titled "Shoe Track Flow Diffuser."

BACKGROUND

During cementing of a well, or borehole, a float collar is a component installed near the bottom of the casing string on which cement plugs land. A float collar typically consists of a short length of casing fitted with a check valve. This valve may be a flapper-valve type or a spring-loaded ball valve. The check-valve assembly within the float collar prevents flowback of the cement slurry when pumping ceases.

A float shoe is a component installed in the casing string below the float collar prior to running the casing in the well. The interval between the float shoe and the float collar is called the shoe track. During cementing, the entire internal diameter of the casing does not flow with cement slurry, especially in highly deviated wells. Specifically, cement slurry flows through the shoe track in jet streams such that the cross sectional area of the fluid flowing through the collar is much less than the cross sectional area of the casing internal diameter. As such, the entire shoe track does not fully evacuate, thus creating an undesirable flow path between the casing and the annulus, creating pockets of uneven fluid that reduces integrity, and leaving uncovered openings in the float shoe that should be covered with cement.

SUMMARY

An apparatus for controlling the flow of cement slurry in a well casing includes a cylindrical housing and a hopper within the cylindrical housing to collect the cement slurry. The apparatus further includes tubing, including at least one tube, coupled to the hopper within the cylindrical housing to transport the cement slurry from the hopper to at least one exit port. The apparatus further includes a bottom plate coupled to the tubing, the bottom plate including at least one exit port shaped to diffuse the cement slurry and arranged on the bottom plate such that the cement slurry flows along the entire internal diameter of the well casing.

A method of controlling the flow of cement slurry in a well casing includes collecting the cement slurry, separating and transporting the collected cement slurry using more than two tubes, and diffusing the cement slurry along the entire internal diameter of the well casing using a bottom plate coupled to the tubes. The bottom plate includes more than two exit ports shaped to diffuse the cement slurry and arranged on the bottom plate such that the cement slurry flows along the entire internal diameter of the well casing.

An apparatus for controlling the flow of cement slurry in a well casing includes a hopper to collect the cement slurry and tubing including a main tube, at least one upper tube, and at least one lower tube. The apparatus further includes a bottom plate coupled to the tubing, the bottom plate including more than two exit ports shaped to diffuse the cement slurry and arranged on the bottom plate such that the cement slurry flows along the entire internal diameter of the well casing. The main tube is coupled to the hopper to transport the cement slurry from the hopper to the center of the internal diameter of the well casing. The upper tube is coupled to the hopper to transport the cement slurry from the hopper to an outer portion of the internal diameter of the well casing. The lower tube is coupled to the main tube to transport the cement slurry from the main tube to another outer portion of the internal diameter of the well casing.

BRIEF DESCRIPTION OF THE DRAWINGS

Apparatuses, systems, and methods of flow diffusion are disclosed herein. In the drawings.

Figure 1:
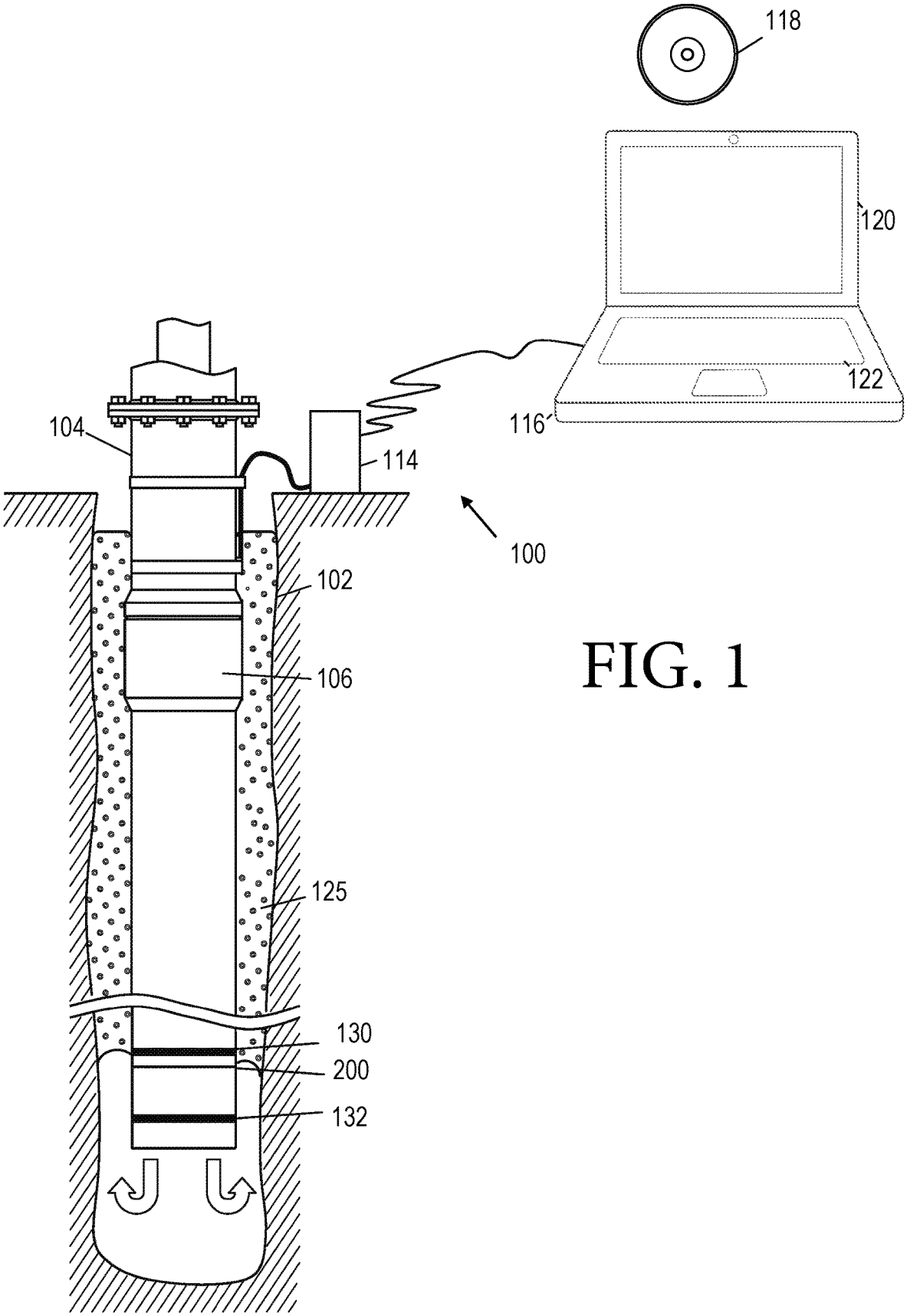
FIG. 1 depicts a system of flow diffusion in accordance with at least one embodiment.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Certain terms are used throughout the following description and claims to refer to particular system components and configurations. As one of ordinary skill will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ".

FIG. 1 shows an illustrative borehole 102 that has been drilled into the earth. Such boreholes 102 are routinely drilled to ten thousand feet or more in depth and can be steered horizontally for twice that distance. During the drilling process, the driller circulates a drilling fluid to clean cuttings from the bit and carry them out of the borehole 102. In addition, the drilling fluid is normally formulated to have a desired density and weight to approximately balance the pressure of native fluids in the formation. Thus the drilling fluid itself can at least temporarily stabilize the borehole 102 and prevent blowouts. To provide a more permanent solution, the driller inserts a casing string 104 into the borehole 102. The casing string 104 is normally formed from lengths of tubing joined by threaded tubing joints 106. The driller connects the tubing lengths together as the casing string 104 is lowered into the borehole 102.

The casing string 104 may be coupled to a measurement unit 114 that senses one or more parameters of the casing 104 including temperature, pressure, strain, acoustic (noise) spectra, acoustic coupling, chemical (e.g., hydrogen or hydroxyl) concentration, flow diffuser effectiveness, and the like. The measurement unit 114 may process each measurement and combine it with other measurements to obtain a high-resolution measurement of that parameter. Though FIG. 1 shows a cable as the sensing element, alternative embodiments of the system variously employ an array of spaced-apart sensors that communicate measurement data via wired or wireless channels to the measurement unit 114. A data processing system 116 may periodically retrieve the measurements as a function of position and establish a time record of those measurements. Software, represented by information storage media 118, runs on the data processing system 116 to collect the measurement data and organize it in a file or database. The software further responds to user input via a keyboard or other input mechanism 122 to display the measurement data as an image or movie on a monitor or other output mechanism 120 such as a printer. Some software embodiments provide audible and/or visual alerts to the user, especially in the case of abnormal behavior within the system 100.

To cement the casing 104, the drilling crew injects a cement slurry 125 into the annular space (typically by pumping the slurry 125 through the casing 104 to the bottom of the borehole 102, which then forces the slurry 125 to flow back up through the annular space around the casing 104). The software and/or the crew monitors the measurement data in real time or near real time to observe the profile of the selected parameter (i.e., the value of the parameter as a function of depth) and to observe the evolution of the profile (i.e., the manner in which the profile changes as a function of time).

A float collar 130 and float shoe 132 are installed in the casing string 104 prior to running the casing 104 in the hole 102. The float shoe 132 and the float collar 130 are separated by at least one casing joint. The interval between the float shoe 132 and the float collar 130 is called the shoe track. During cementing, a flow diffuser 200 ensures the entire internal diameter of the casing 104 flows and is filled with cement slurry 125, which sets (hardens or cures) to provide the primary barrier in the well barrier envelope. Without the flow diffuser 200, especially in highly deviated wells, the entire internal diameter of the casing string 104 does not in fact flow or fill with cement slurry 125. Specifically, the cement slurry 125 exits the float collar 130 in one or more jet streams. Considering the internal diameter of the casing 104 versus the flow diameter of the stream(s), the cross sectional area of the fluid exiting the collar 130 is less than 50% of the cross sectional area of the casing 104 internal diameter. As a result, the entire shoe track does not fully evacuate, flow with cement, or fill with cement. This creates an undesirable flow path between the casing 104 and the annulus, creates pockets of uneven fluid (e.g. washes, spacer fluid, or drilling fluid) that reduces integrity, and leaves uncovered openings in the float shoe 132 that should be covered with cement. These uncovered openings undesirably allow fluid to flow when pressure is applied to the string.

The flow diffuser 200 diffuses the flow downstream of the float collar 130 such that cement slurry 125 flows and fills the entire internal diameter of the casing string 104, leading to a complete evacuation of the shoe track and replacement of the original fluid with cement. Specifically, the flow pattern changes from a jet stream pattern to a diffused or deflected flow such that the internal diameter of the casing 104 in the shoe track section is radially covered. As such, no undesirable flow paths are created, no pockets of uneven fluid cause reduced integrity, and all openings in the float shoe 132 are covered with cement. In the embodiment of FIG. 1, the flow diffuser 200 is installed in the shoe track, below the float collar 130 and above the float shoe 132, of the casing 104 before running the casing in the hole 102. In other embodiments, the flow diffuser 200 is integrated into the float collar 130 itself, and both are installed together.

Figure 3:
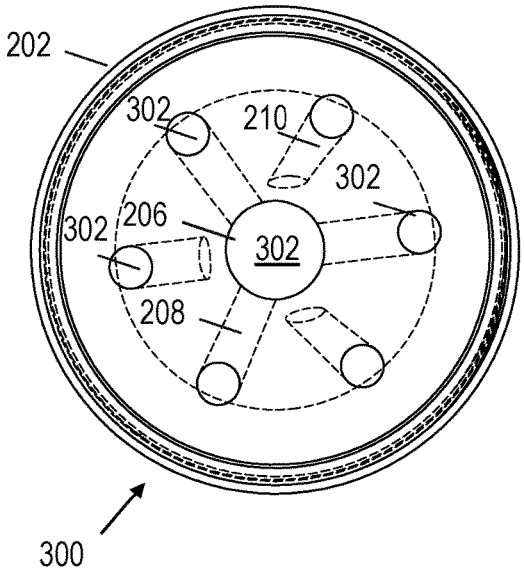
FIG. 3 depicts a bottom view of an apparatus for flow diffusion in accordance with at least one embodiment.
Figure 2:
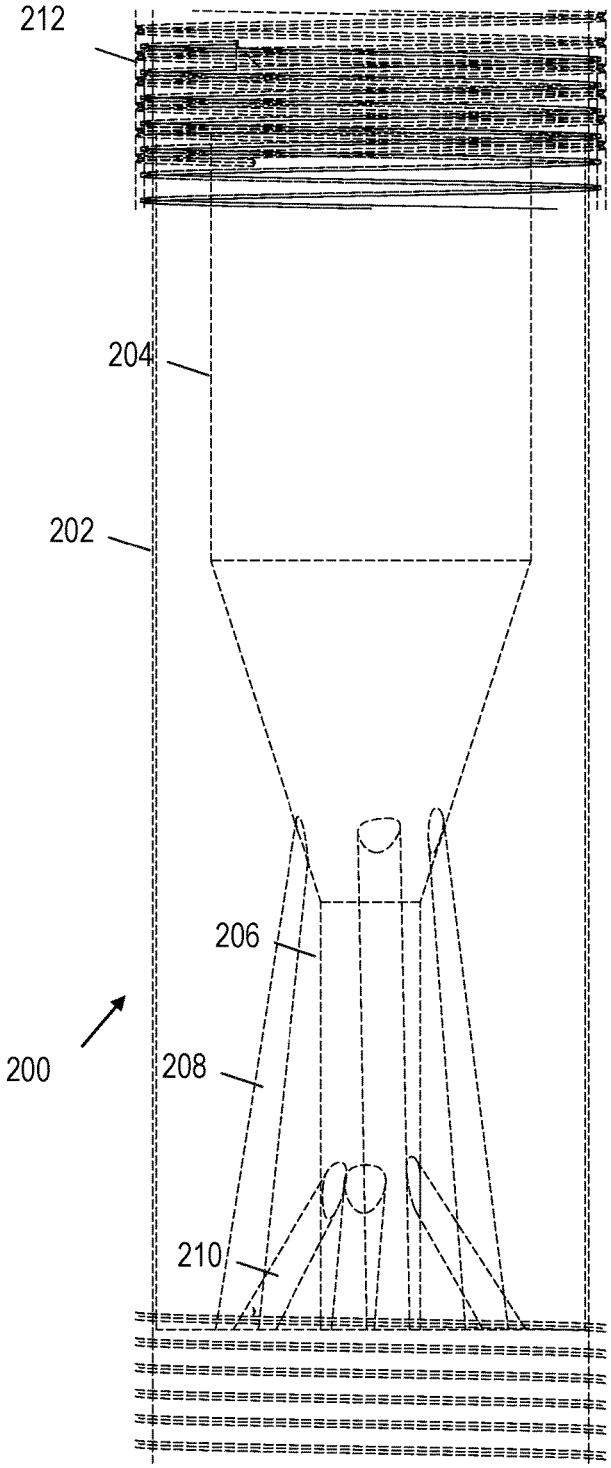
FIG. 2 depicts a side view of an apparatus for flow diffusion in accordance with at least one embodiment.

FIGS. 2 and 3 show a side view and a bottom view of a flow diffuser 200 in accordance with at least one embodiment. The flow diffuser 200 includes a cylindrical housing 202 and a hopper 204 within the cylindrical housing 202 to collect the cement slurry 125. The hopper 204 may collect the cement slurry 125 from a float collar 130 that delivers the cement slurry 125 in one or more jet streams.

The flow diffuser 200 further includes tubing 206, 208, 210, including at least one tube 206, 208, coupled to the hopper 204 within the cylindrical housing 202 to transport the cement slurry 125 from the hopper 204 to at least one exit port 302. At least one tube 208, 210 may angled such that the cement slurry 125 enters the well casing 104 at a first angle. At least another tube 208, 210 may angled such that the cement slurry 125 enters the well casing 104 at a second angle, the first angle not equal to the second angle.

As shown in the embodiment of FIG. 2, the tubing 206, 208, 210 includes a main tube 206, at least one upper tube 208, and at least one lower tube 210. The main tube 206 is coupled to the hopper 204 to transport the cement slurry 125 from the hopper to the center of the internal diameter of the well casing 104. The main tube 206 may be straight, in the center of the housing 202, and a smaller diameter than the others 208, 210. The upper tube 208 is coupled to the hopper 204 to transport the cement slurry 125 from the hopper 104 to an outer portion of the internal diameter of the well casing 104. The lower tube 210 is coupled to the main tube 206 to transport the cement slurry 125 from the main tube 206 to another outer portion of the internal diameter of the well casing 104.

The flow diffuser 200 further includes a bottom plate 300 coupled to the tubing 206, 208, 210. The bottom plate 300 includes at least one exit port 302 shaped to diffuse the cement slurry 125 and arranged on the bottom plate 300 such that the cement slurry 125 flows along the entire internal diameter of the well casing 104 and fills the shoe track. At least one exit port 302 may be angled such that the cement slurry 125 enters the well casing 104 at a first angle. At least another exit port 302 may be angled such that the cement slurry 125 enters the well casing 104 at a second angle, the first angle not equal to the second angle. The well casing 104 may deviated from the vertical and the exit ports 302 may be shaped to diffuse the cement slurry 125 in the shoe track such that no openings in a float shoe 132 are exposed to non-cementitious fluid.

As shown in the embodiment of FIG. 3, one exit port 302 is circularly shaped and located in the middle of the bottom plate 300 to deliver a portion of the cement slurry 125 to the center of the internal diameter of the well casing 104 via the main tube 206, thus precluding a low-pressure region from forming in the center of the internal diameter of the well casing 104 that would retain a column of unwanted fluid in the shoe track. Other exit ports 302 are radially arranged around the one exit port 302, alternately couple to the upper tubes 208 and lower tubes 210. The exit ports 302 are shaped to diffuse the cement slurry 125 and arranged on the bottom plate 300 such that the cement slurry 125 flows along the entire internal diameter of the well casing 104. In at least one embodiment, the exit port 302 located in the middle of the bottom plate 300 is shaped not to deflect the cement slurry 125, while the exit ports 302 located radially around the bottom plates are shaped to deflect the cement slurry at various angles. For example, the radial exit ports 302 may be shaped like a scoop, slide, ramp, or the like to deflect the cement slurry 125.

As shown in the embodiment of FIG. 2, the flow diffuser 200 includes threaded ends 212 to couple with a casing string 104. In another embodiment, the flow diffuser 200 is integrated into a float collar 130. In yet another embodiment, the flow diffuser 200 is anchored inside the casing and couples to the casing via welded connection. In various other embodiments, more than one flow diffusers 200 may be installed in the same shoe track. One or more measurement devices 114 may be installed to monitor diffusion and wirelessly command adjustment of the angles of the tubing 206, 208, 210 or exit ports 302 in real time, while the cement slurry 125 flows through the diffuser 200, via movement of mechanical hinges or exit port caps that completely or partially cover the exit ports 302. Specifically, the system 100 may include software 118 that automatically, or manually with the expertise of a user, adjusts the flow diffuser 200 in response to less than ideal diffusion measured by the measurement devices 114.

Figure 4:
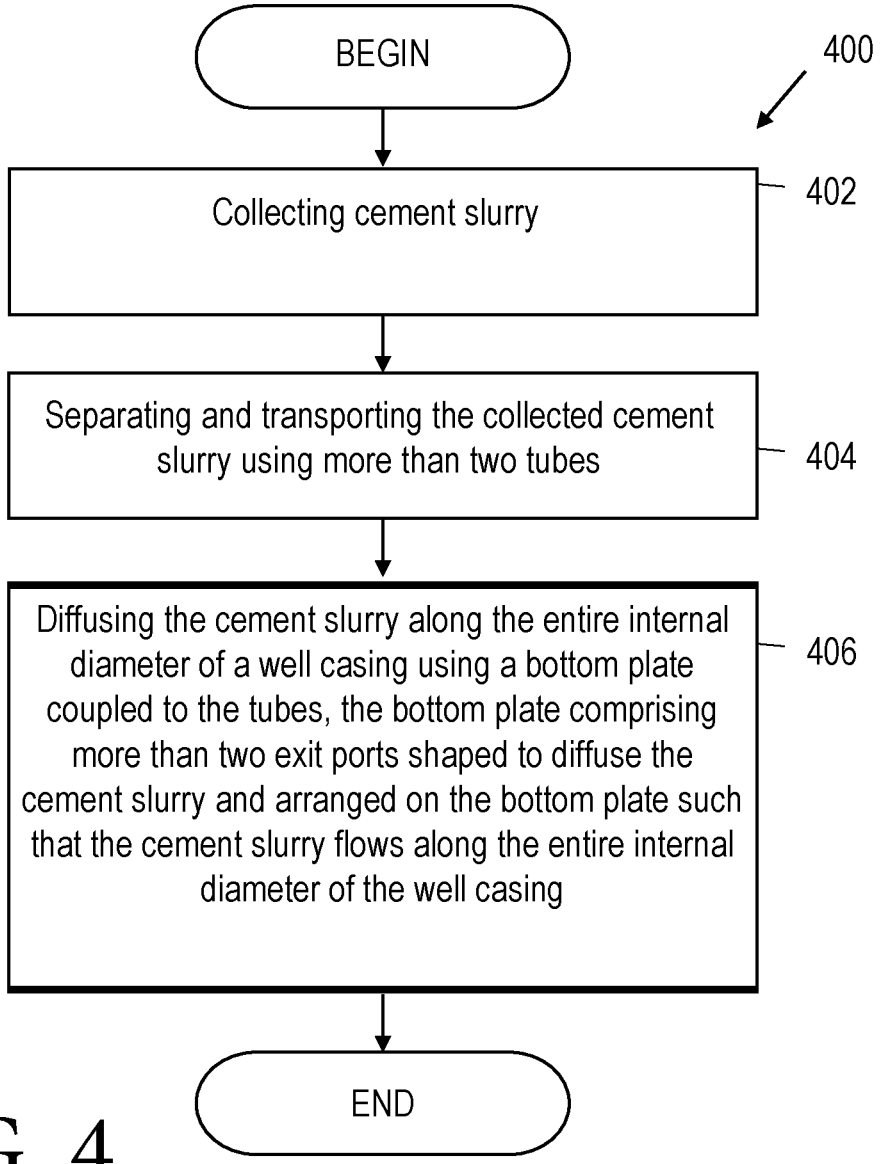
FIG. 4 depicts a method of flow diffusion in accordance with at least one embodiment.

FIG. 4 illustrates a method 400 of controlling flow of cement slurry in a well casing that may include any step described above. At 402, the cement slurry is collected. At 404, the collected cement slurry is separated and transported using more than two tubes. Collecting the cement slurry may include collecting the cement slurry from a float collar that delivers the cement slurry in one or more jet streams.

At 406, the cement slurry is diffused along the entire internal diameter of the well casing using a bottom plate coupled to the tubes. The bottom plate includes more than two exit ports shaped to diffuse the cement slurry and arranged on the bottom plate such that the cement slurry flows along the entire internal diameter of the well casing. At least one exit port may be angled such that the cement slurry enters the well casing at a first angle, and at least another exit port may be angled such that the cement slurry enters the well casing at a second angle, the first angle not equal to the second angle. At least one tube may be angled such that the cement slurry enters the well casing at a first angle, and at least another tube may be angled such that the cement slurry enters the well casing at a second angle, the first angle not equal to the second angle.

The well casing may be deviated from the vertical and the exit ports may be shaped to diffuse the cement slurry such that no openings in a float shoe are exposed to non-cementitious fluid. The method 400 may further include installing the tubes and bottom plate between a float shoe and a float collar on a casing string. The method 400 may further include installing the tubes and bottom plate into a float collar.

The flow diffuser 200 ensures that the non-cementitious fluid in the shoe track, downstream of the float collar 130, is in fact fully displaced and replaced with cement as opposed to theoretically displaced as many assume. After the cement 125 sets, it provides a hydraulic seal in the shoe track and also prevents the valves in the float shoe 132 and float collar 130 from opening under applied pressure in the casing string 104. Accordingly, the flow diffuser 200 ensures that the well barrier envelope required by regulation is achieved throughout the life of the well 102.

In some aspects, apparatuses, systems, and methods for flow diffusion are provided according to one or more of the following examples:

Example 1: An apparatus for controlling flow of cement slurry in a well casing includes a cylindrical housing and a hopper within the cylindrical housing to collect the cement slurry. The apparatus further includes tubing, including at least one tube, coupled to the hopper within the cylindrical housing to transport the cement slurry from the hopper to at least one exit port. The apparatus further includes a bottom plate coupled to the tubing, the bottom plate including at least one exit port shaped to diffuse the cement slurry and arranged on the bottom plate such that the cement slurry flows along the entire internal diameter of the well casing.

Example 2: A method of controlling flow of cement slurry in a well casing includes collecting the cement slurry, separating and transporting the collected cement slurry using more than two tubes, and diffusing the cement slurry along the entire internal diameter of the well casing using a bottom plate coupled to the tubes. The bottom plate includes more than two exit ports shaped to diffuse the cement slurry and arranged on the bottom plate such that the cement slurry flows along the entire internal diameter of the well casing.

Example 3: An apparatus for controlling flow of cement slurry in a well casing includes a hopper to collect the cement slurry and tubing including a main tube, at least one upper tube, and at least one lower tube. The apparatus further includes a bottom plate coupled to the tubing, the bottom plate including more than two exit ports shaped to diffuse the cement slurry and arranged on the bottom plate such that the cement slurry flows along the entire internal diameter of the well casing. The main tube is coupled to the hopper to transport the cement slurry from the hopper to the center of the internal diameter of the well casing. The upper tube is coupled to the hopper to transport the cement slurry from the hopper to an outer portion of the internal diameter of the well casing. The lower tube is coupled to the main tube to transport the cement slurry from the main tube to another outer portion of the internal diameter of the well casing.

The following features may be incorporated into the various embodiments described above, such features incorporated either individually in or conjunction with one or more of the other features:

At least one exit port may be angled such that the cement slurry enters the well casing at an angle. At least one tube may be angled such that the cement slurry enters the well casing at an angle. At least one exit port may angled such that the cement slurry enters the well casing at a first angle, and at least another exit port may be angled such that the cement slurry enters the well casing at a second angle, the first angle not equal to the second angle. At least one tube may be angled such that the cement slurry enters the well casing at a first angle, and at least another tube may be angled such that the cement slurry enters the well casing at a second angle, the first angle not equal to the second angle. The well casing may be deviated and the exit ports may be shaped to diffuse the cement slurry in the shoe track such that no openings in a float shoe are exposed to non-cementitious fluid. One exit port may be circularly shaped and located in the middle of the bottom plate to deliver a portion of the cement slurry to the center of the internal diameter of the well casing, thus precluding a low-pressure region from forming in the center of the internal diameter of the well casing. Other exit ports may radially arranged around one exit port. The hopper may collect the cement slurry from a float collar that delivers the cement slurry in one or more jet streams. The flow diffuser may be installed between a float shoe and a float collar on a casing string. The flow diffuser may be integrated into a float collar. The flow diffuser may include threaded ends to couple with a casing string. The tubes and bottom plate may be installed between a float shoe and a float collar on a casing string. The tubes and bottom plate may be installed into a float collar. Collecting the cement slurry may include collecting the cement slurry from a float collar that delivers the cement slurry in one or more jet streams.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments in this disclosure have been described in terms of preferred embodiments, those skilled in the art will recognize that the embodiments herein can be practiced with modification within the spirit and scope of the embodiments as described herein. Numerous other modifications, equivalents, and alternatives, will become apparent once the above disclosure is fully appreciated. It is intended that the following claims be interpreted to embrace all such modifications, equivalents, and alternatives where applicable.

What is claimed is:

1. An apparatus for controlling flow of cement slurry in a well casing comprising:

a cylindrical housing;

a hopper within the cylindrical housing to collect the cement slurry;

tubing, comprising at least one tube, coupled to the hopper within the cylindrical housing to transport the cement slurry from the hopper to at least one exit port; and a bottom plate coupled to the tubing, the bottom plate comprising at least one exit port shaped to diffuse the cement slurry within the casing, and arranged on the bottom plate such that the cement slurry flows along the entire internal diameter of the well casing;

wherein the apparatus is configured to be installed between a float collar and a float shoe.

2. The apparatus of claim 1, wherein at least one exit port is angled such that the cement slurry enters the well casing at an angle.

3. The apparatus of claim 1, wherein at least one tube is angled such that the cement slurry enters the well casing at an angle.

4. The apparatus of claim 1, wherein at least one exit port is angled such that the cement slurry enters the well casing at a first angle, and wherein at least another exit port is angled such that the cement slurry enters the well casing at a second angle, the first angle not equal to the second angle.

5. The apparatus of claim 1, wherein at least one tube is angled such that the cement slurry enters the well casing at a first angle, and wherein at least another tube is angled such that the cement slurry enters the well casing at a second angle, the first angle not equal to the second angle.

6. The apparatus of claim 1, wherein the well casing is deviated from the vertical and the exit ports are shaped to diffuse the cement slurry in a shoe track such that no openings in the float shoe are exposed to non-cementitious fluid.

7. The apparatus of claim 1, wherein one exit port is circularly shaped and located in the middle of the bottom plate to deliver a portion of the cement slurry to the center of the internal diameter of the well casing, thus precluding a low-pressure region from forming in the center of the internal diameter of the well casing.

8. The apparatus of claim 7, wherein other exit ports are radially arranged around the one exit port.

9. The apparatus of claim 1, wherein the hopper collects the cement slurry from the float collar that delivers the cement slurry in one or more jet streams.

10. The apparatus of claim 1, further comprising threaded ends to couple with a casing string.

11. A method of controlling flow of cement slurry in a well casing comprising:

collecting the cement slurry;

separating and transporting the collected cement slurry using more than two tubes; and diffusing the cement slurryalong the entire internal diameter of the well casing, between a float collar and a float shoe, using a bottom plate coupled to the tubes, the bottom plate comprising more than two exit ports shaped to diffuse the cement slurry within the casing, and arranged on the bottom plate such that the cement slurry flows along the entire internal diameter of the well casing.

12. The method of claim 11, wherein at least one exit port is angled such that the cement slurry enters the well casing at a first angle, and wherein at least another exit port is angled such that the cement slurry enters the well casing at a second angle, the first angle not equal to the second angle.

13. The method of claim 11, wherein at least one tube is angled such that the cement slurry enters the well casing at a first angle, and wherein at least another tube is angled such that the cement slurry enters the well casing at a second angle, the first angle not equal to the second angle.

14. The method of claim 11, wherein the well casing is deviated from the vertical and the exit ports are shaped to diffuse the cement slurry such that no openings in the float shoe are exposed to non-cementitious fluid.

15. The method of claim 11, wherein collecting the cement slurry comprises collecting the cement slurry from the float collar that delivers the cement slurry in one or more jet streams.

16. An apparatus for controlling flow of cement slurry in a well casing comprising:

a hopper to collect the cement slurry;

tubing comprising a main tube, at least one upper tube, and at least one lower tube; and a bottom plate coupled to the tubing, the bottom plate comprising more than two exit ports shaped to diffuse the cement slurry within the casing, and arranged on the bottom plate such that the cement slurryflows along the entire internal diameter of the well casing;

wherein the main tube is couped to the hopper to transport the cement slurry from the hopper to the center of the internal diameter of the well casing;

wherein the upper tube is coupled to the hopper to transport the cement slurry from the hopper to an outer portion of the internal diameter of the well casing;

wherein the lower tube is coupled to the main tube to transport the cement slurry from the main tube to another outer portion of the internal diameter of the well casing; and wherein the apparatus is configured to be installed between a float collar and a float shoe.

* * * * *